US007165374B2

(12) United States Patent
Ohanesian

(10) Patent No.: US 7,165,374 B2
(45) Date of Patent: Jan. 23, 2007

(54) WALL SYSTEM AND METHOD

(76) Inventor: Viken Ohanesian, 26 Pacific Crest, Laguna Niguel, CA (US) 92677

( * ) Notice: Subject to any disclaimer, the term of this patent is extended or adjusted under 35 U.S.C. 154(b) by 503 days.

(21) Appl. No.: 10/779,054

(22) Filed: Feb. 13, 2004

(65) Prior Publication Data

US 2005/0183385 A1 Aug. 25, 2005

(51) Int. Cl.
*E04C 2/32* (2006.01)
*E04C 1/00* (2006.01)

(52) U.S. Cl. ..... 52/783.1; 52/783.11; 52/783.19; 52/798.1; 52/799.1; 52/309.15; 52/309.12; 52/309.14; 52/424; 52/425; 52/800.15; 52/800.12; 52/581; 52/588.1; 52/586.2

(58) Field of Classification Search ..... 52/309.4, 52/309.6, 309.7, 309.8, 309.12, 309.14, 309.15, 52/309.17, 408, 415, 424–425, 439, 783.17, 52/783.18, 783.14, 796.14, 800.1, 800.11, 52/800.12, 800.13, 800.14, 800.16, 800.17, 52/802.1, 802.11, 311.2, 313–314, 316, 783.1, 52/783.11, 783.19, 798.1, 799.1, 578, 580, 52/581, 588.1, 582.1, 586.1, 586.2, 585.1
See application file for complete search history.

(56) References Cited

U.S. PATENT DOCUMENTS 2,825,221 A * 3/1958 Brouk ..... 52/293.1
3,000,144 A * 9/1961 Kitson ..... 52/309.11
3,304,673 A * 2/1967 Ramoneda ..... 52/220.3
4,937,125 A * 6/1990 Sanmartin et al. ..... 428/116
5,129,203 A * 7/1992 Romero ..... 52/309.11
5,622,019 A * 4/1997 Dorough, Jr. ..... 52/308
5,921,047 A * 7/1999 Walker ..... 52/585.1
6,282,853 B1 * 9/2001 Blaney et al. ..... 52/223.7
6,502,357 B1 * 1/2003 Stuthman et al. ..... 52/241
6,701,683 B1 * 3/2004 Messenger et al. ..... 52/309.11
2001/0023559 A1 * 9/2001 Ozawa et al. ..... 52/100
2002/0062545 A1 * 5/2002 Niedermair ..... 29/417
2002/0106504 A1 * 8/2002 Stott ..... 428/315.9

* cited by examiner

*Primary Examiner*—Jeanette E. Chapman
(74) *Attorney, Agent, or Firm*—Myers Dawes Andras & Sherman LLP; Vic Lin; Joseph C. Andras

(57) ABSTRACT

A multi-layer wall panel includes a core filler material surrounded by two plastic sheets. Each sheet includes three-dimensional texture formed to resemble masonry or other desired aesthetics. A layer of concrete may be disposed between each sheet and the filler material. The sheet may be removed from the concrete layers to expose the concrete surfaces. Multiple wall panels may be stacked on top of one another and joined side-by-side with posts and connectors to form a wall assembly. A method for manufacturing vertical concrete wall structures is also provided.

12 Claims, 6 Drawing Sheets

WALL SYSTEM AND METHOD

BACKGROUND OF THE INVENTION

1. Field of the Invention

The present invention relates generally to thermoplastic fencing, wall and building structures.

2. Description of Prior Art and Related Information

Plastic wall structures associated with the prior art include fencing assemblies having individual components. Such assemblies require a plurality of parts which are expensive to manufacture. Furthermore, assembling so many individual components is time consuming, especially if a large overall structure is contemplated.

Vertical concrete walls are often desirable as an inexpensive alternative to expensive stone walls composed of, granite or marble, for example. Since they can be sculpted and colored to resemble expensive stone surfaces, concrete can often serve as a cheaper substitute for a wall desired in a residential or commercial setting. Conventional manufacturing of concrete walls, however, consists of producing the walls in a facility and allowing the concrete to cure in the facility. Such an approach is time consuming and inefficient since a concrete manufacturing facility is unable to operate at full capacity due to the storage of the curing concrete.

Concrete walls can also be quite heavy and difficult to transport and manage. What is needed is a more lightweight vertical concrete structure that is inexpensive to manufacture.

SUMMARY OF THE INVENTION

The present invention provides structures and methods which overcome the deficiencies in the prior art.

In one aspect, a multi-layer wall panel is provided. The panel comprises a first plastic sheet, a second plastic sheet and a filler material disposed between the first plastic sheet and the second plastic sheet. The first plastic sheet has a first outer surface and a first inner surface. The first outer surface comprises a first three-dimensional texture. The first inner surface is substantially parallel to the first outer surface. The second plastic sheet has a second outer surface and a second inner surface. The second outer surface comprises a second three-dimensional texture. The second inner surface is substantially parallel to the second outer surface. The second plastic sheet is disposed in a back-to-back relationship with the first plastic sheet such that the second inner surface faces the first inner surface. The first plastic sheet and the second plastic sheet may each be composed of vinyl.

The filler material may comprise a composite of polyurethane, a composite of polyurethane and waste materials, concrete, a foam material such as polystyrene, a composite of concrete and polystyrene, a composite of concrete and waste materials, or any other materials or composites that is lightweight and inexpensive to manufacture.

Each of the three-dimensional textures may be formed to resemble other masonry, other building materials, or any other aesthetically pleasing appearance as desired. For example, the three-dimensional textures may be formed to resemble a brick pattern, pavers, a random assortment of stones, and more.

The panel further comprises one or more side rails coupled to the first plastic sheet and second plastic sheet. Each side rail comprises a U-channel configured to receive a post. The panel may further comprise a top rail and a bottom rail configured to mate with the top rail. The panel also comprises a top decorative cap covering the top rail.

The panel may also include a first concrete layer disposed between the filler material and the first vinyl sheet as well as a second concrete layer disposed between the filler material and the second vinyl sheet. The first concrete layer may be permanently attached to, or removable from, the first inner surface of the first plastic sheet. The second concrete layer may also be permanently attached to, or removable from, the second inner surface of the second plastic sheet.

In another aspect, an outdoor wall assembly is provided. The assembly comprises a first wall panel and a second wall panel. The first wall panel includes a first plastic sheet and a second plastic sheet. The first plastic sheet has a first outer surface and a first inner surface. The first outer surface comprises a first three-dimensional texture. The first inner surface is substantially parallel to the first outer surface. The second plastic sheet has a second outer surface and a second inner surface. The second outer surface comprises a second three-dimensional texture. The second inner surface is substantially parallel to the second outer surface. The second plastic sheet is disposed in a back-to-back relationship with the first plastic sheet such that the second inner surface faces the first inner surface. A first filler material is disposed between the first plastic sheet and the second plastic sheet. The first wall panel further comprises a first bottom rail and a first top rail.

The second wall panel is disposed on top of the first wall panel. The second wall panel includes a third plastic sheet and a fourth plastic sheet. The third plastic sheet has a third outer surface and a third inner surface. The third outer surface comprises a third three-dimensional texture. The third inner surface is substantially parallel to the third outer surface. A fourth plastic sheet has a fourth outer surface and a fourth inner surface. The fourth outer surface comprises a fourth three-dimensional texture. The fourth inner surface is substantially parallel to the fourth outer surface. The fourth plastic sheet is disposed in a back-to-back relationship with the third plastic sheet such that the fourth inner surface faces the third inner surface. A second filler material is disposed between the third plastic sheet and the fourth plastic sheet. The second wall panel further comprises a second top rail, a second bottom rail configured to mate with the first top rail, and a first side rail.

The wall assembly further comprises a post coupled to the first side rail. The first side rail comprises a U-channel configured to receive the post. The assembly further comprises a top decorative cap covering the second top rail. The first top rail and the second bottom rail are configured to removably mate with each other. In particular, the first top rail comprises a longitudinal male portion while the second bottom rail comprises a longitudinal female portion. The first filler material and the second filler material may comprise polyurethane. The first plastic sheet, the second plastic sheet, the third plastic sheet and the fourth plastic sheet preferably comprise vinyl.

A first concrete layer may be disposed between the first plastic sheet and the first filler material. A second concrete layer may be disposed between second plastic sheet and the first filler material. The second wall panel may comprise a third concrete layer disposed between the third plastic sheet and the second filler material as well as a fourth concrete layer disposed between fourth plastic sheet and the second filler material. In such an assembly, the first filler material and the second filler material may be composed of a foam material, such as polystyrene.

A method for manufacturing vertical concrete walls is also provided. The method comprises providing a portable mold having an inner surface contoured with a texture desired for an outer surface of a concrete wall, pouring concrete into the portable mold, curing the concrete in the portable mold, and removing the portable mold from the concrete. The method further comprises transporting the portable mold with the poured concrete to a destination while the concrete is curing in the portable mold.

Removing the portable mold from the concrete comprises removing the portable mold from the concrete at the destination. Pouring concrete into the portable mold comprises pouring concrete into the portable mold at a facility. Curing the concrete in the portable mold comprises curing the concrete in the portable mold away from the facility. A layer of foam may be attached to the concrete in the portable mold. The method further comprising re-using the portable mold.

In summary, a multi-layer wall panel includes a core filler material surrounded by two plastic sheets. Each sheet includes three-dimensional texture formed to resemble masonry or other desired aesthetics. A layer of concrete may be disposed between each sheet and the filler material. The sheet may be removed from the concrete layers to expose the concrete surfaces. Multiple wall panels may be stacked on top of one another and joined side-by-side with posts and connectors to form a wall assembly. A method for manufacturing vertical concrete wall structures is also provided.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
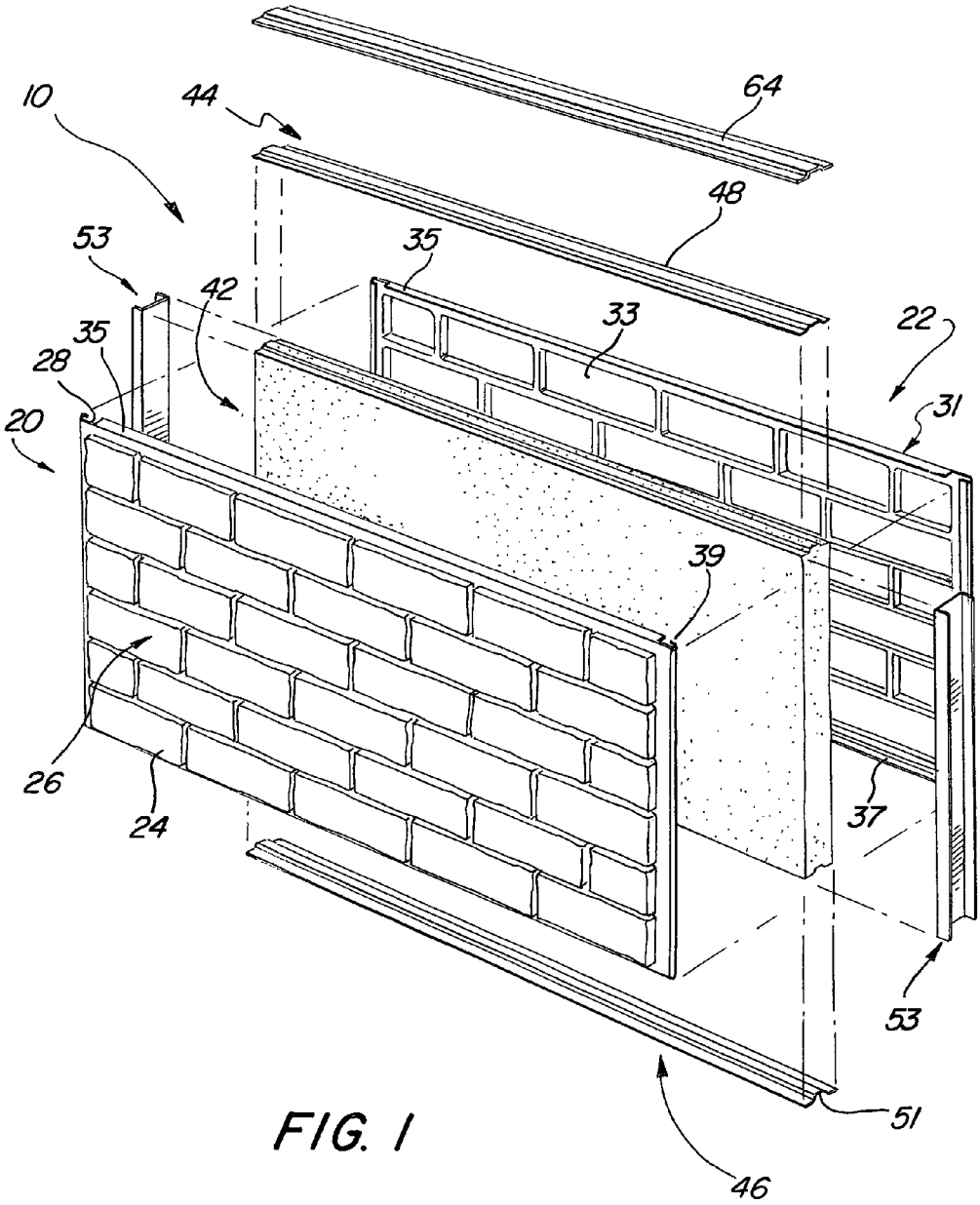
FIG. 1 is an exploded, perspective view of a first preferred embodiment of a wall panel according to the invention.
Figure 3:
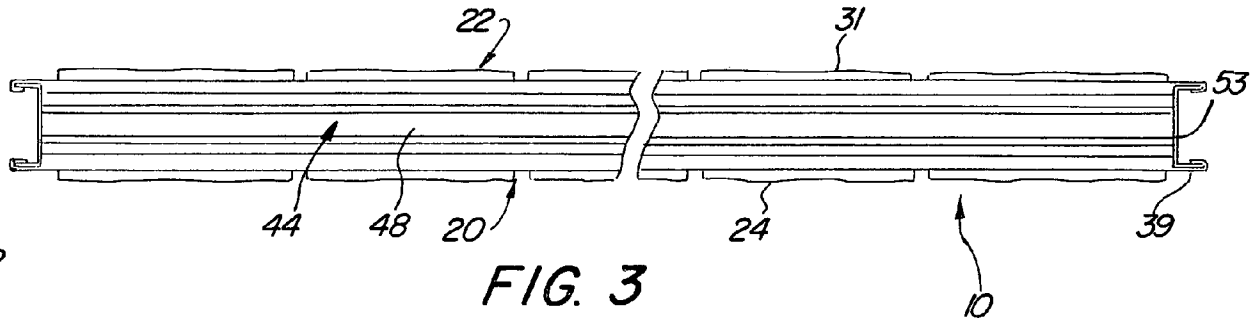
FIG. 3 is a top view of the first preferred wall panel.
Figure 2:
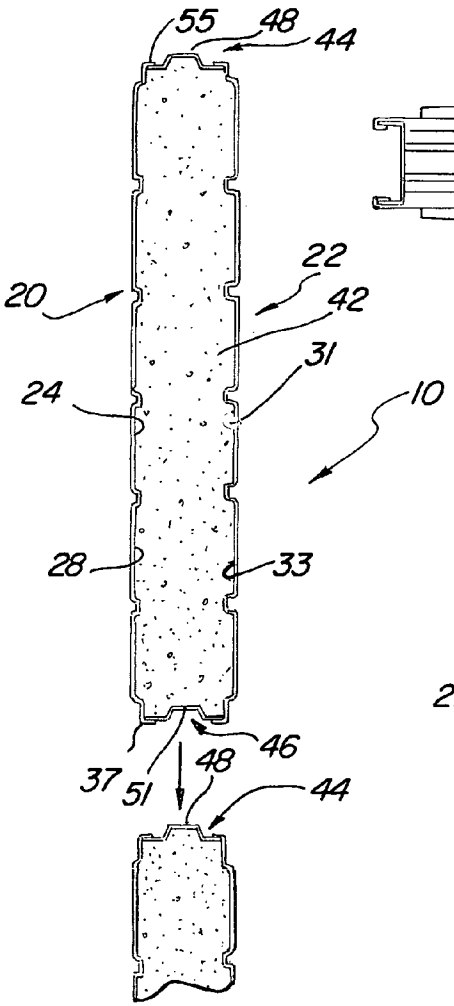
FIG. 2 is a top to bottom cross-sectional view of the first preferred wall panels.

In FIGS. 1–3, a first preferred embodiment of a wall panel 10 is illustrated in exploded view. The wall panel 10 comprises a first outer sheet 20 and a second outer sheet 22 disposed in a back-to-back relationship. The sheets 20, 22 are preferably composed of plastic, such as vinyl. In particular, the first sheet 20 comprises a front, outer surface 24 with a three-dimensional texture which can be made to resemble natural masonry or stone work. In the illustrated embodiment shown in FIG. 1, the three-dimensional texture resembles a brick pattern 26. The sheet 20 preferably comprises a thin layer of the plastic material such that an inner, the rear surface 28, shown in FIG. 2, is substantially parallel to the outer surface 24. Accordingly, rear surface 28 comprises an inverted brick pattern.

The second sheet 22 may be configured to be substantially similar to the structure of the first sheet 22. Thus, the second sheet 22 comprises a front, outer surface 31 also having a three-dimensional texture, which is shown in FIG. 1 as a brick pattern. The sheet 22 further comprises a rear, inner surface 33 that is substantially parallel to the outer surface 31 and, therefore, configured with an inverted pattern of the three dimensional texture of the outer surface 31. When assembled in the back-to-back configuration, the inner surfaces 28, 33 of the sheets 20, 22, respectively, face each other.

Each sheet 20, 22 preferably comprises a top horizontal flange 35, a bottom horizontal flange 37 and side hooks 39 which shall be discussed in more detail below.

In the first preferred embodiment shown in FIGS. 1–2, a filler material 42 is disposed between the outer sheets 20, 22. The filler material 42 may comprise any lightweight yet sturdy material that is inexpensive to manufacture. As examples, the filler material 42 may comprise polyurethane, waste materials, polystyrene foam, concrete, and/or a composite of two or more of any of the foregoing.

The wall panel 10 is preferably configured to be modular so that the panel 10 may be joined with other panels to form a wall assembly as discussed below in connection with FIG. 4. Accordingly, the panel 10 comprises a top rail 44 and a bottom rail 46 configured to removably mate with each other. In the illustrated embodiment, the top rail 44 comprises a longitudinal male section 48 while the bottom rail 46 comprises a female section 51 although it should be expressly understood that the female and male sections can be interchanged with the top and bottom rails. The top rail 44 and bottom rail 46 cover the filler material 42 while the top horizontal flange 35 and bottom horizontal flange 37 cover and secure portions of the top rail 44 and bottom rail 46, respectively.

Side rails 53 are preferably formed as U-channels and received within the side hooks 39 of the sheets 20, 22. In combination with the sheets 20, 22, the top rail 44 and bottom rail 46, the side rails 53 cover the filler material 42 such that the filler material 42 is entirely encapsulated.

Figure 4:
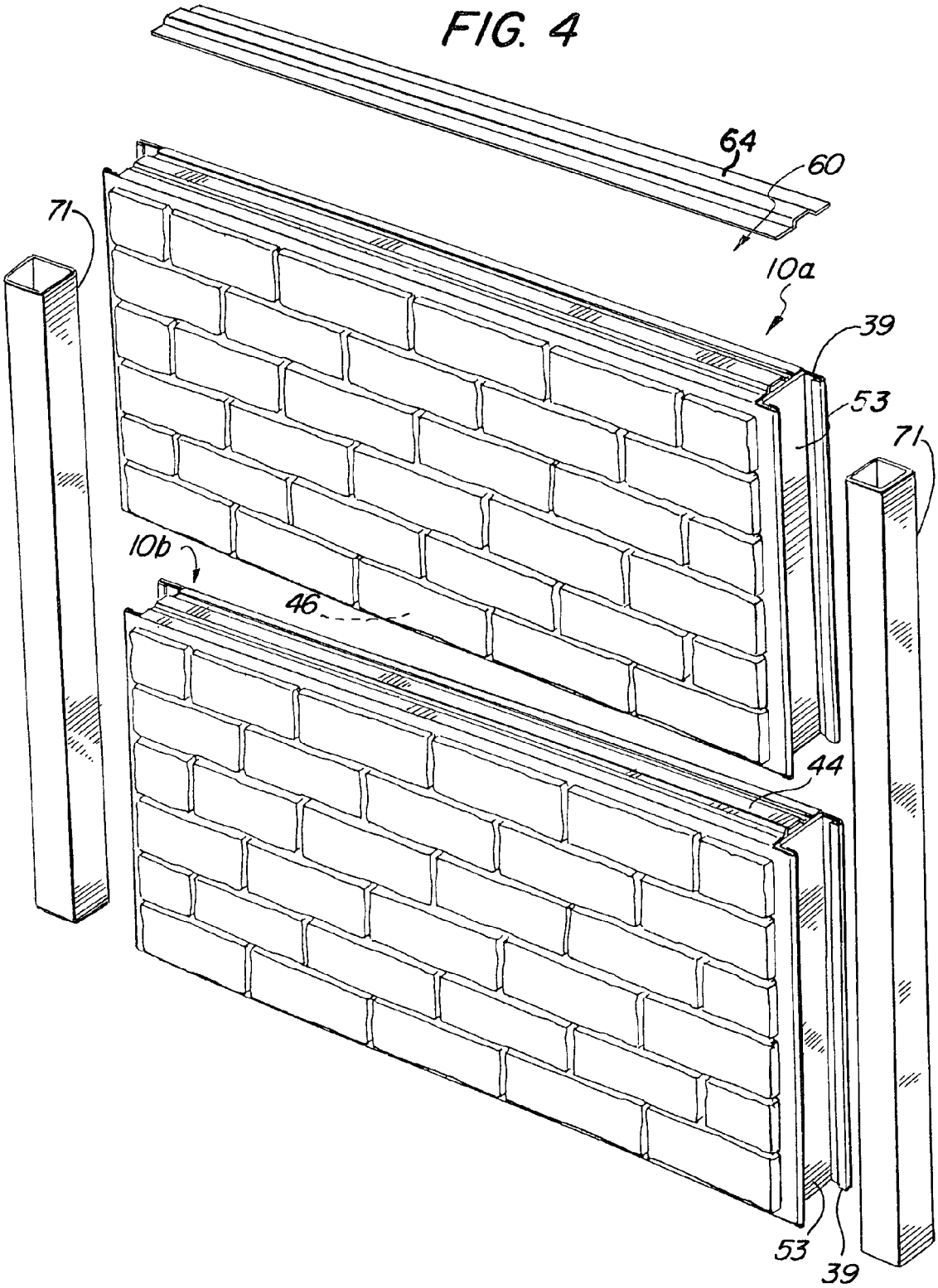
FIG. 4 is an exploded, perspective view of a first preferred embodiment a wall assembly.

In FIG. 4, a preferred embodiment of a wall assembly 60 comprises a plurality of the first preferred wall panels 10*a*, 10*b*. In the illustrated embodiment shown in FIG. 4, a top wall panel 10*a* is stacked on top of a bottom wall panel 10*b*. It will be appreciated that the top rail 44 of the bottom panel 10*b* removably mates with a female section 51 of the top panel 10*a*, as shown more clearly in FIG. 3. The side rails 53 and side hooks 39 collectively form a recess to receive posts 62. A top decorative cap 64 is disposed on top of the top wall panel 10*a* to cover the top rail 44 and form an aesthetically pleasing appearance.

It will be appreciated that the modular components described above collectively form a wall assembly 60 that may be easily configured to provide an outdoor barrier that is aesthetically pleasing. The outer surfaces of the sheets may be varied at the manufacturing stage so as to provide an endless variety of three-dimensional textures that may be desired by the user. As an example and not by way of limitation, the three-dimensional texture may be configured as a stone pattern. In all the embodiments, it is contemplated that the surfaces may be colored, e.g. by painting, in order to provide as natural and/or aesthetically pleasing appearance as desired.

The ease of interconnectability of the modular panels 10 is illustrated in FIGS. 2 and 3. Thus, whether the panels 10 are being joined side-by-side or on top of one another, the panels 10 are configured to be easily joined to form a wall assembly.

Figure 5:
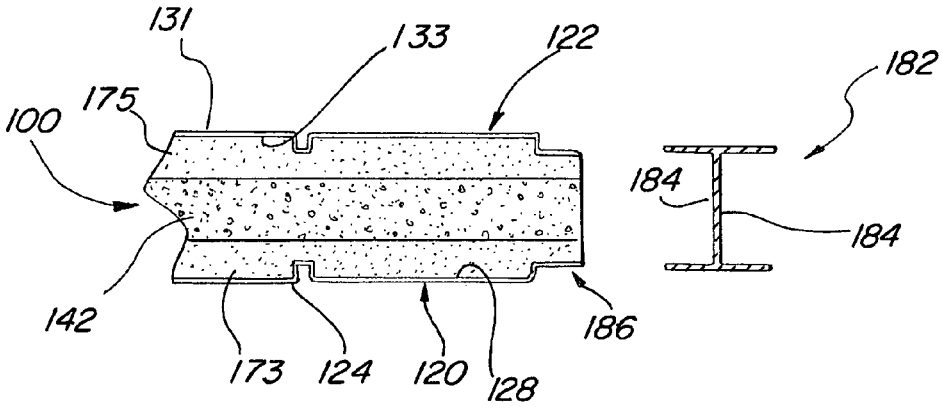
FIG. 5 is a cross-sectional view of a second preferred embodiment of a wall panel.

A second preferred embodiment of a wall panel 100 is illustrated in FIG. 5. In this embodiment, the wall panel 100 comprises a first outer sheet 120 and a second outer sheet 122, disposed in a back-to-back relationship. Each panel 120, 122 is preferably composed of a plastic material such as vinyl. The first sheet 120 comprises a front, outer surface 124 with a three-dimensional texture which can be made to resemble natural masonry or stone work. The sheet 120 preferably comprises a thin layer of the plastic material such that an inner, rear surface 128 is substantially parallel to the outer surface 124. Accordingly, the rear surface 128 comprises an inverted brick pattern.

The second sheet 122 may be configured to be substantially similar to the structure of the first sheet 122. Thus, the second sheet 122 comprises a front, outer surface 131 also having a three-dimensional texture. The sheet 122 further comprises a rear, inner surface 133 that is substantially parallel to the outer surface 131 and, therefore, configured with an inverted pattern of the three dimensional texture of the outer surface 131. When assembled in the back-to-back configuration, the inner surfaces 128, 133 of the sheets 120, 122, respectively, face each other.

In the second preferred embodiment shown in FIG. 5, a core filler material 142 is disposed between the outer sheets 120, 122. The core filler material 142 may comprise any lightweight yet sturdy material that is inexpensive to manufacture. As examples, the filler material 142 may comprise polyurethane, waste materials, polystyrene foam, concrete, and/or a composite of two or more of any of the foregoing. In the illustrated embodiment, the filler material 142 preferably comprises foam.

In this embodiment, a first layer 173 is disposed between the filler material 142 and the first sheet 120 while a second layer 175 is disposed between the filler material 142 and the second sheet 122. Thus, the panel 100 comprises a pair of layers 173, 175 disposed on opposing sides of the filler material 142. In the preferred embodiment, the layers 173, 175 preferably comprise concrete, or a composite including concrete and other materials. Alternatively, the layers 173, 175 may be composed of any other substantially rigid material which will provide the panel 110 with overall strength and durability to withstand outdoor conditions. The layers 173, 175 may be either detachable from, or permanently attached to, the filler material 142.

The layers 173, 175 may be permanently attached to the sheets 120, 122, respectively, by bonding, for example. Alternatively, the sheets 120, 122 may be removable from layers 173, 175 so as to expose the layers 173, 175. For example, the layers 173, 175 may be composed of concrete with a certain three-dimensional texture resembling stone or any kind of decorative pattern. In such a case, it may be desirable to expose the concrete layers 173, 175 which can be colored and/or painted so as to form an aesthetically pleasing structure. A side connector 182 shown in exploded view from the panel 100 has an a "I" profile and comprises two opposing U-channels 184 configured to receive side portions 186 of the panels 100.

Figure 6:
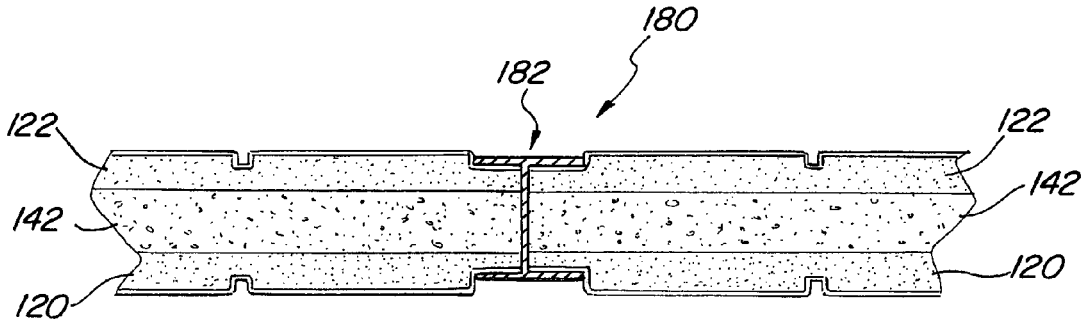
FIG. 6 is a cross-sectional view of a second preferred embodiment of a wall assembly comprising the wall panel shown in FIG. 5.

FIG. 6 is a cross-sectional view of a second preferred embodiment of a wall assembly 180. Instead of employing rectangular posts 71 as shown in FIG. 2, the assembly 180 employs the side connectors 182. The U-channels 184 serve not only to couple one wall panel 100 to another in a side-by-side arrangement, they also serve to hold the layers 173, 175, filler material 142 and, optionally, the outer sheets 120, 122 together to securely form the panel 100.

Figure 7:
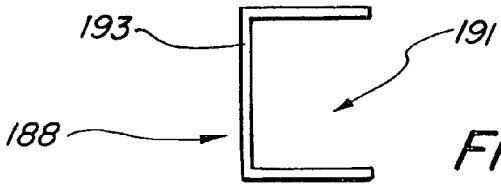
FIG. 7 is a top view of an alternate post.

In an alternative embodiment shown in FIG. 7, a side connector 188 may comprise a single U-channel 191 with a back surface 193 that abuts the side portion 186 of the panel 100. The connector 188 may be fastened to the concrete layers 173, 175 and/or filler material 142, shown in FIG. 5, so as to hold the panel 100 together especially if the layers 173, 175 are not bonded or otherwise attached to the filler material 142. The U-channel 191 which faces away from the panel 100 now provides a recess to receive a post such as the rectangular post shown in FIG. 2. In addition, the panel 100 may comprise mating top and bottom rails substantially similar to those associated with the first preferred wall panel 10 described above and illustrated in FIGS. 1–4.

It will be appreciated that a vertical wall structure 100 is provided having a lightweight and inexpensive core, and sturdy concrete outer walls which may or may not be covered by sheets of plastic material. If the plastic sheets remain on the concrete walls, the sheets may be colored and/or decorated so to provide an aesthetically pleasing appearance. If not, the exposed concrete walls may be chiseled, colored and/or otherwise configured so as to form any desired appearance such as that resembling a stone pattern.

Figure 8:
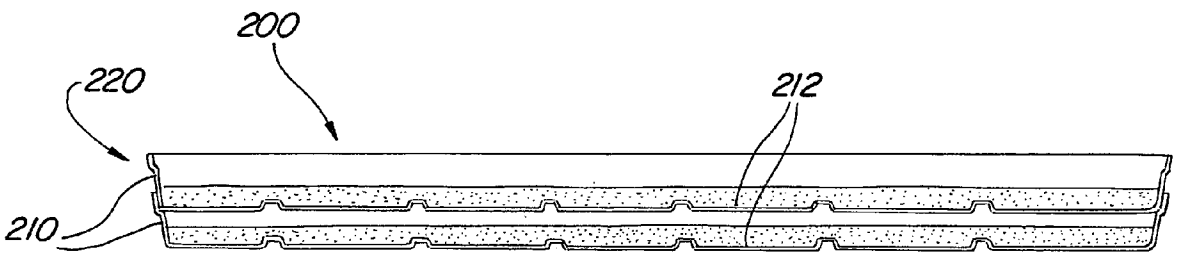
FIG. 8 is a cross-sectional view of a stack of molds each carrying cement poured therein.
Figure 9:
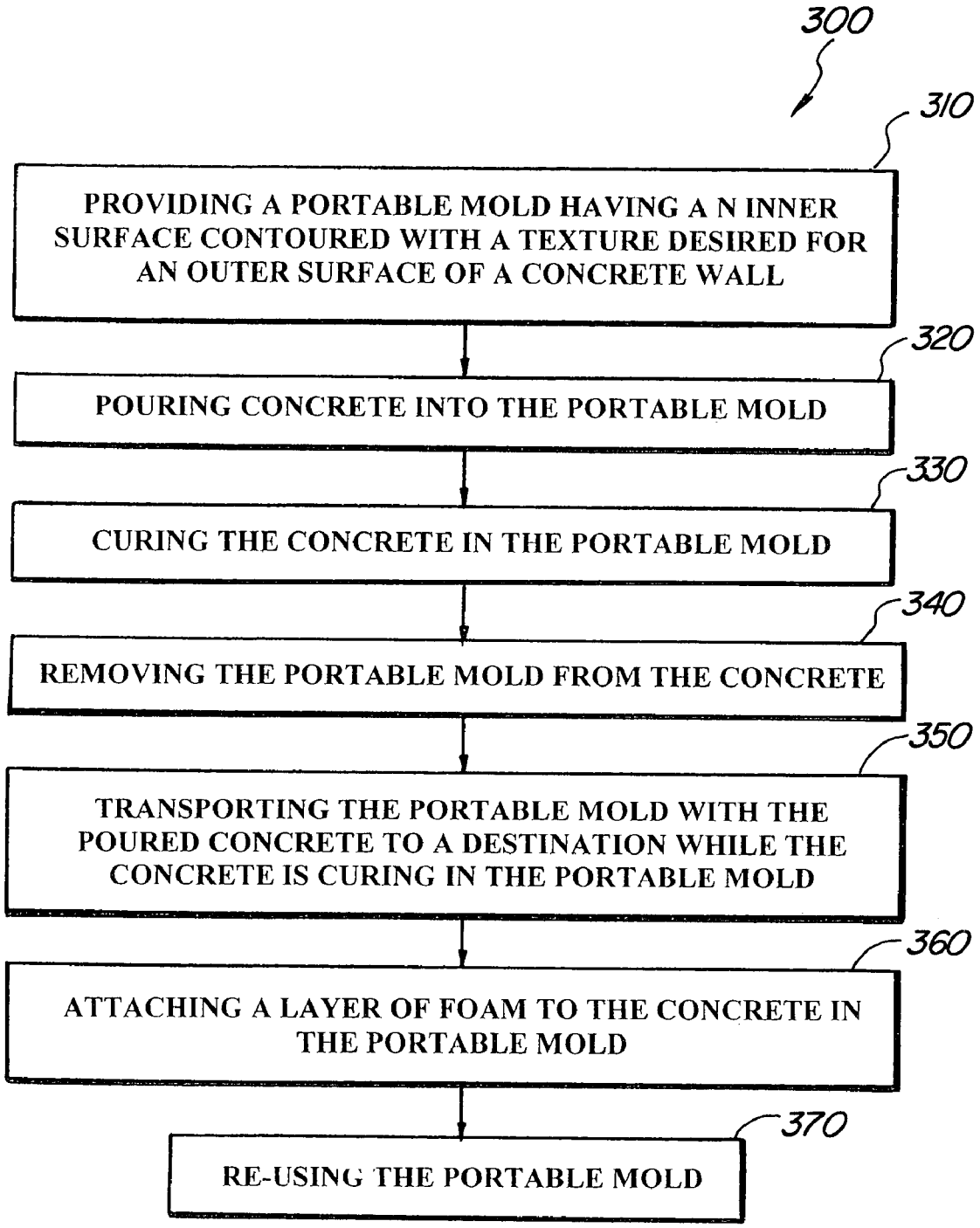
FIG. 9 illustrates a method of manufacturing vertical concrete walls.

A preferred method of manufacturing concrete walls is illustrated in FIGS. 8 and 9. In FIG. 8, stackable molds 210 have an inner contour configured to provide the desired outer three-dimensional texture of the concrete wall. Concrete 212 is poured into the re-usable molds 210 which are then stacked on top of another. The stack 220 is then capable of being stored and/or transported away from a manufacturing facility so as to increase production capacity thereof. The concrete 212 is allowed to cure in the molds 210, for example, while the molds 210 are being transported to a destination site. Once the concrete 212 cures, the mold 210 may then be removed from the now formed concrete wall 212 and be reused. The concrete wall 212 may then be painted or however decorated for aesthetics and then be put to use.

As shown in FIG. 9, a preferred method 300 of manufacturing vertical concrete structures is provided. The method 300 comprises the step 310 of providing a portable mold having an inner surface contoured with a texture desired for an outer surface of a concrete wall. In step 320, concrete is poured into the portable mold, which preferably comprises plastic, such as vinyl. The concrete may be poured into the portable mold at a facility, such as a manufacturing plant. The concrete is cured in the portable mold in step 330. In this step, the concrete may be cured in the portable mold away from the facility, e.g., while in transport to a destination. Step 340 comprises removing the portable mold from the concrete. This step may include removing the portable mold from the concrete at the destination. The method 300 may further comprise the step 350 of transporting the portable mold with the poured concrete to a destination while the concrete is curing in the portable mold, step 360 of attaching a layer of foam to the concrete in the portable mold and step 370 of re-using the portable mold.

It will be appreciated that unlike conventional techniques for manufacturing vertical concrete structures which generally occur inside a manufacturing facility, the curing process for the vertical concrete structures, such as walls, can now take place entirely outside the facility, thereby enabling a radical increase in production capacity. According to the invention, facilities no longer need to reserve space and time to allow for the curing process.

Figure 10:
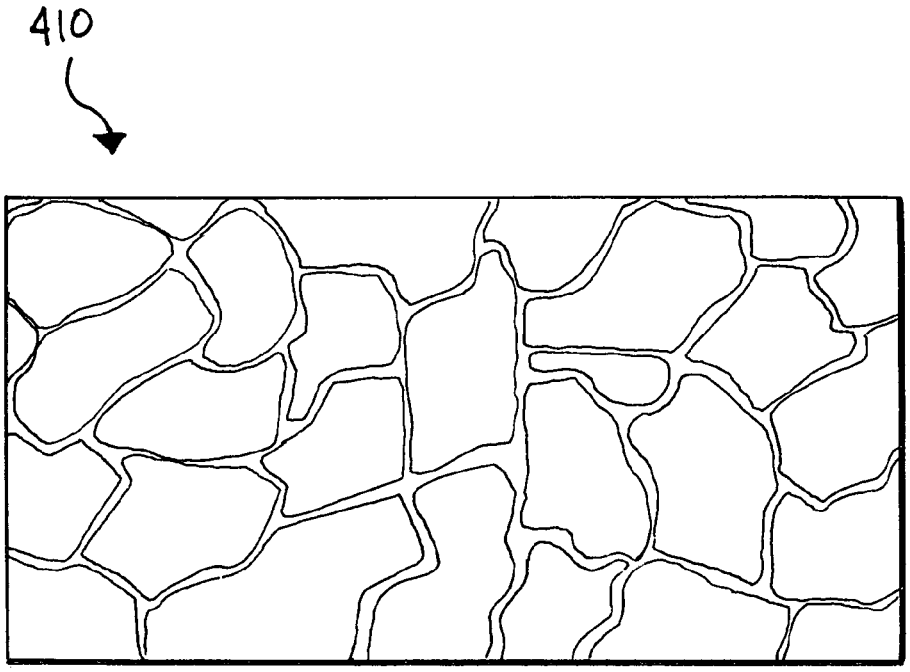
FIG. 10 is a front elevation view of a vertical concrete wall comprising a three-dimensional texture resembling a random stone pattern.
Figure 11:
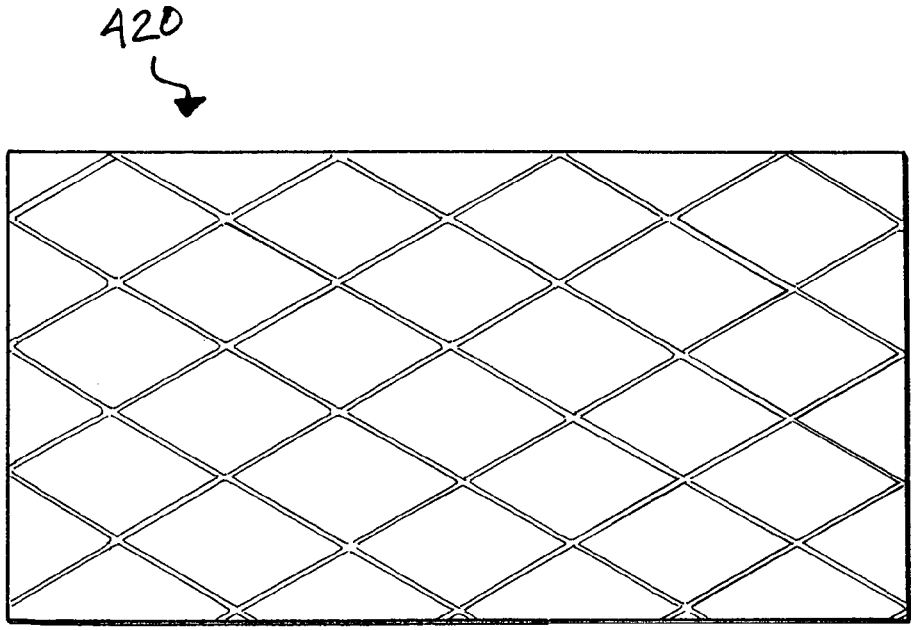
FIG. 11 is a front elevation view of a vertical concrete wall comprising a three-dimensional texture resembling rectangular tiles in a diagonal pattern.

Furthermore, the vertical concrete walls may be formed with an appropriate mold such that the end product comprises a three-dimensional texture having an appearance other than concrete. For example, in FIG. 10, the concrete wall 410 may be formed to include a three-dimensional texture resembling a random assortment of stones to create a flagstone or cobblestone effect. In FIG. 11, the concrete wall 420 may be formed to include a three-dimensional texture resembling rectangular or square tiles in a diagonal pattern so as to resemble, for example, marble, granite, or stone tiles. The walls in FIGS. 10 and 11 may be further refined by chiseling and/or coloring so that the end result resembles a high end, expensive product.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. An outdoor wall assembly, comprising:

a first wall panel including:

a first plastic sheet having a first outer surface and a first inner surface, the first outer surface comprising a first three-dimensional texture, the first inner surface being substantially parallel to the first outer surface;

a second plastic sheet having a second outer surface and a second inner surface, the second outer surface comprising a second three-dimensional texture, the second inner surface being substantially parallel to the second outer surface, the second plastic sheet being disposed in a back-to-back relationship with the first plastic sheet such that the second inner surface faces the first inner surface;

a first filler material disposed between the first plastic sheet and the second plastic sheet;

a first bottom rail; and a first top rail;

a second wall panel disposed on top of the first wall panel, the second wall panel including:

a third plastic sheet having a third outer surface and a third inner surface, the third outer surface comprising a third three-dimensional texture, the third inner surface being substantially parallel to the third outer surface;

a fourth plastic sheet having a fourth outer surface and a fourth inner surface, the fourth outer surface comprising a fourth three-dimensional texture, the fourth inner surface being substantially parallel to the fourth outer surface, the fourth plastic sheet being disposed in a back-to-back relationship with the third plastic sheet such that the fourth inner surface faces the third inner surface; and a second filler material disposed between the third plastic sheet and the fourth plastic sheet;

a second top rail; and a second bottom rail configured to mate with the first top rail.

2. The assembly of claim 1, further comprising a first side rail.

3. The assembly of claim 2, further comprising a post coupled to the first side rail.

4. The assembly of claim 3, wherein the first side rail comprises a U-channel configured to receive the post.

5. The assembly of claim 1, further comprising a top decorative cap covering the second top rail.

6. The assembly of claim 1, wherein the first top rail and the second bottom rail are configured to removably mate with each other.

7. The assembly of claim 6, wherein:

the first top rail comprises a longitudinal male portion; and the second bottom rail comprises a longitudinal female portion.

8. The assembly of claim 1, wherein the first filler material and the second filler material each comprises polyurethane.

9. The assembly of claim 1, wherein the first wall panel comprises:

a first concrete layer disposed between the first plastic sheet and the first filler material; and a second concrete layer disposed between second plastic sheet and the first filler material.

10. The assembly of claim 9, wherein the second wall panel comprises:

a third concrete layer disposed between the third plastic sheet and the second filler material; and a fourth concrete layer disposed between fourth plastic sheet and the second filler material.

11. The assembly of claim 9, wherein the first filler material and the second filler material each comprises a foam material.

12. The assembly of claim 1, wherein the first plastic sheet, the second plastic sheet, the third plastic sheet and the fourth plastic sheet comprise vinyl.

* * * * *